US007984831B2

(12) United States Patent
Kanfer et al.

(10) Patent No.: US 7,984,831 B2
(45) Date of Patent: Jul. 26, 2011

(54) HANDHELD DISPENSERS FOR PERSONAL USE

(75) Inventors: Joseph S. Kanfer, Richfield, OH (US); Robert L. Quinlan, Stow, OH (US); Mark E. Rosenkranz, Medina, OH (US); Daniel E. Kustra, Brunswick, OH (US)

(73) Assignee: GOJO Industries, Inc., Akron, OH (US)

( * ) Notice: Subject to any disclaimer, the term of this patent is extended or adjusted under 35 U.S.C. 154(b) by 365 days.

(21) Appl. No.: 12/288,785

(22) Filed: Oct. 23, 2008

(65) Prior Publication Data

US 2010/0102085 A1 Apr. 29, 2010

(51) Int. Cl.
*B67D 7/76* (2010.01)
*B65D 37/00* (2006.01)

(52) U.S. Cl. ..... 222/190; 222/207; 222/209

(58) Field of Classification Search ..... 222/94, 222/95, 96, 105, 107, 135, 145.1, 145.5, 222/205, 207, 209, 212, 213, 214, 215, 190, 222/383.1; 401/188 R, 205, 206, 270, 278
See application file for complete search history.

(56) References Cited

U.S. PATENT DOCUMENTS 3,048,878 A * 8/1962 Gray et al. ..... 401/10
3,471,064 A * 10/1969 Micallef ..... 222/211
5,911,716 A * 6/1999 Rake et al. ..... 604/890.1
6,536,635 B1 * 3/2003 Garcia et al. ..... 222/633
6,752,298 B2 * 6/2004 Garcia et al. ..... 222/633
6,789,706 B2 9/2004 Abergel et al.
6,871,759 B2 * 3/2005 Rake et al. ..... 222/103
6,981,614 B2 * 1/2006 Niggemyer ..... 222/107
7,419,322 B2 9/2008 Laflamme et al.
7,625,114 B2 * 12/2009 Suchan et al. ..... 366/130
7,780,039 B2 * 8/2010 Criswell et al. ..... 222/108
2006/0186140 A1 8/2006 Kanfer et al.
2008/0203110 A1 8/2008 LaFlamme et al.
2008/0223875 A1 9/2008 LaFlamme et al.
2008/0237262 A1 * 10/2008 LaFlamme et al. ..... 222/135
2008/0277419 A1 * 11/2008 Holcomb et al. ..... 222/205

* cited by examiner

*Primary Examiner* — Kevin P Shaver
*Assistant Examiner* — Stephanie E Williams
(74) *Attorney, Agent, or Firm* — Renner, Kenner, Greive, Bobak, Taylor & Weber

(57) ABSTRACT

A handheld dispenser includes a collapsible liquid container, a liquid pump, an air pump, and a mixing chamber. The liquid pump provides a collapsible liquid chamber collapsed from an expanded volume to a compressed volume to expel liquid from the collapsible liquid chamber into the mixing chamber. The air pump provides a collapsible air chamber collapsed from an expanded volume to a compressed volume to expel air from the collapsible air chamber into the mixing chamber. The liquid pump and air pump are secured to the collapsible liquid container so as to be capable of being manipulated with one hand. Air expelled into the mixing chamber mixes with liquid expelled into the mixing chamber so that a mixed product is dispensed.

16 Claims, 11 Drawing Sheets

HANDHELD DISPENSERS FOR PERSONAL USE

FIELD OF THE INVENTION

The present invention generally relates to fluid dispensers, and, more particularly, relates to personal, portable fluid dispensers that combine a fluid with air. In an embodiment, this invention provides personal, portable foam dispensers combining a foamable liquid and air. In specific preferred embodiments, this invention relates to portable, personal foam dispensers that are operable to dispense a unit dose of a personal cleaning or sanitizing solution.

BACKGROUND OF THE INVENTION

Personal, portable dispensers for various liquid products are generally known. These fluid dispensers include various types. In some of the simplest forms, portable dispensers are provided as containers that can be selectively opened or closed to dispense the liquid product therein. In some embodiments, these containers give to pressure in order to allow their interior volume to be temporarily decreased in order to dispense some of the liquid product retained therein. These types of containers are very popular for carrying around hand sanitizer, hand cleaner, and hand lotion.

Hand sanitizers, hand cleaners, and hand lotions are also dispensed through the use of dispensers employing positive displacement pumps. Some of these dispensers are sized sufficiently to be portable. These portable dispensers include a piston head that is pushed to dispense liquid product from the main container. They provide the beneficial feature of dispensing a unit dose of liquid product upon activation of their dispensing mechanisms. However, it is easy to accidentally actuate these dispensers by unintentionally pushing on the piston head, for instance when carrying the dispenser in a purse or other luggage. Thus, these dispensers are more preferably for desk top or sink-side use.

Portable, personal dispensers have also been provided having flexible walls and dosing capabilities, as in U.S. Pat. No. 6,789,706 and U.S. Published Patent Application 2006/0255068. A pump communicates with a source of liquid product in a flexible wall container and also communicates with an outlet. Actuation of the pump forces liquid product out at the outlet, and release of the pump draws an additional dose of liquid product from the container to be dispensed upon a subsequent actuation. These are one component dispensers, dispensing a liquid product.

In recent years, it has become popular to dispense many liquids as foam, which is basically a mixture of at least two components, typically of air bubbles dispersed throughout a foamable liquid. Accordingly, in many environments, the standard liquid pump has given way to a foam generating pump, which necessarily requires means for combining air and liquid in such a manner as to generate the desired foam. Accordingly, in a particular embodiment this invention provides flexible wall type dispensers having the ability to dispense a dose of a foam product, thus providing a readily portable foam dispenser for personal use. As will be appreciated from following disclosure, the invention is not limited to foam dispensers, and, instead, also covers any dispenser wherein air is to be combined with a liquid, whether to foam or for any other reason such as to create a reaction.

SUMMARY OF THE INVENTION

This invention provides a handheld dispenser including a collapsible liquid container, a collapsible liquid chamber, a collapsible air chamber, and a mixing chamber. The liquid container defines a volume retaining a liquid. The collapsible liquid chamber communicates with the liquid in the liquid container through a liquid inlet valve, and communicates with the mixing chamber through a liquid outlet path. The collapsible liquid chamber is adapted to be manipulated between an expanded volume and a compressed volume. The collapsible air chamber communicates with air outside the dispenser through an air inlet valve, and communicates with the mixing unit through an air outlet path. The collapsible air chamber is adapted to be manipulated between an expanded volume and a compressed volume. The collapsible liquid chamber and the collapsible air chamber are secured to the collapsible liquid container so as to be capable of being manipulated with one hand. A portion of the liquid is drawn into the collapsible liquid chamber upon expansion of the collapsible liquid chamber from the compressed volume to the expanded volume, and a portion of the liquid within the collapsible liquid chamber is expelled from within the collapsible liquid chamber and forced to the liquid outlet path upon compression of the collapsible liquid chamber from the expanded volume to the compressed volume. Air is drawn into the collapsible air chamber upon expansion of the collapsible air chamber from the compressed volume to the expanded volume, and air within the collapsible air chamber is expelled from within the collapsible air chamber and forced to the air outlet path upon compression of the collapsible air chamber from the expanded volume to the compressed volume. Air forced through the air outlet path and liquid forced through the liquid outlet path meet and mix at the mixing unit.

DETAILED DESCRIPTION OF ILLUSTRATIVE EMBODIMENTS

Figure 1:
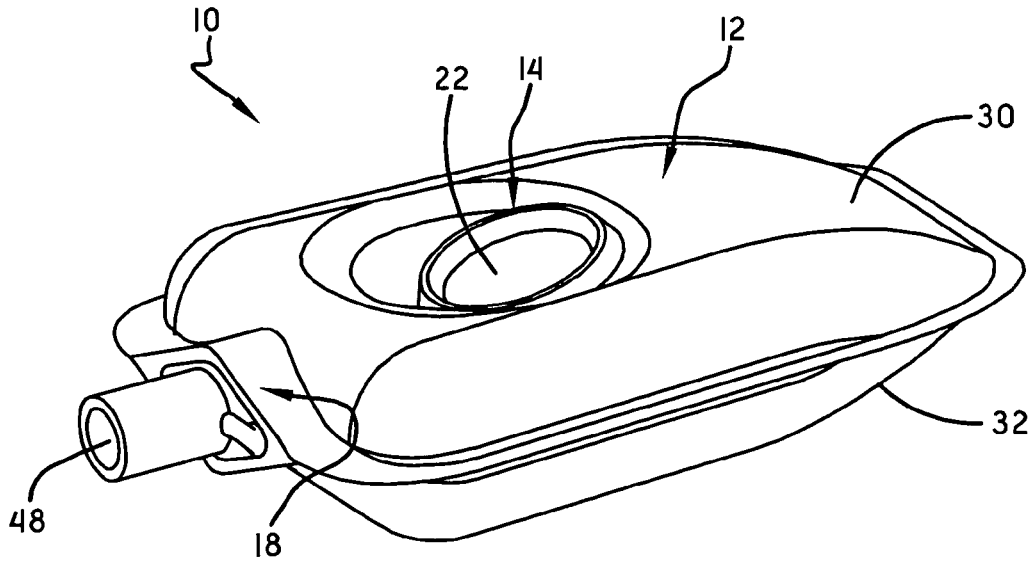
FIG. 1 is a perspective view of a first embodiment of a dispenser in accordance with this invention.
Figure 2:
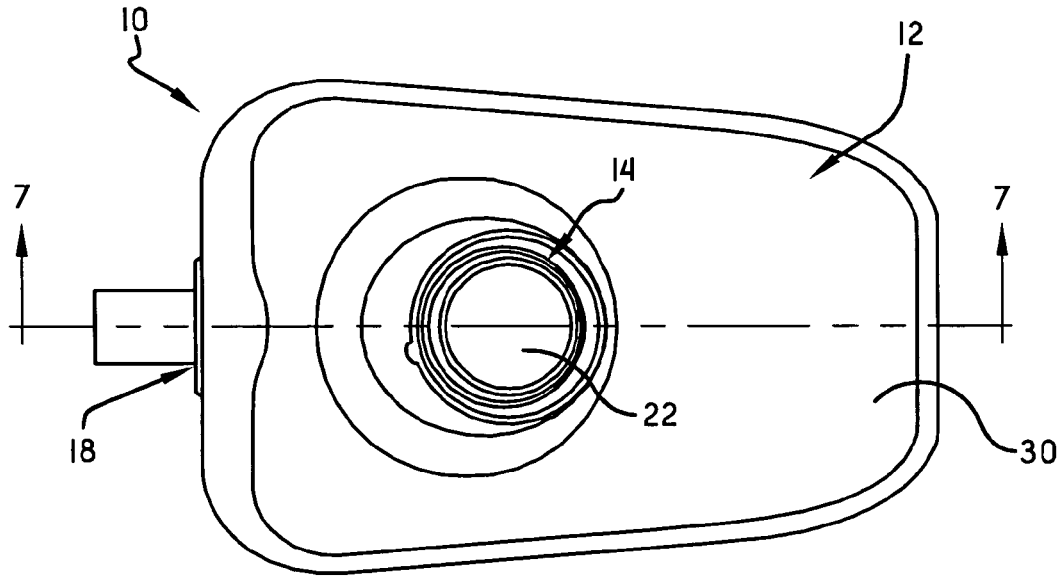
FIG. 2 is a top view thereof.
Figure 3:
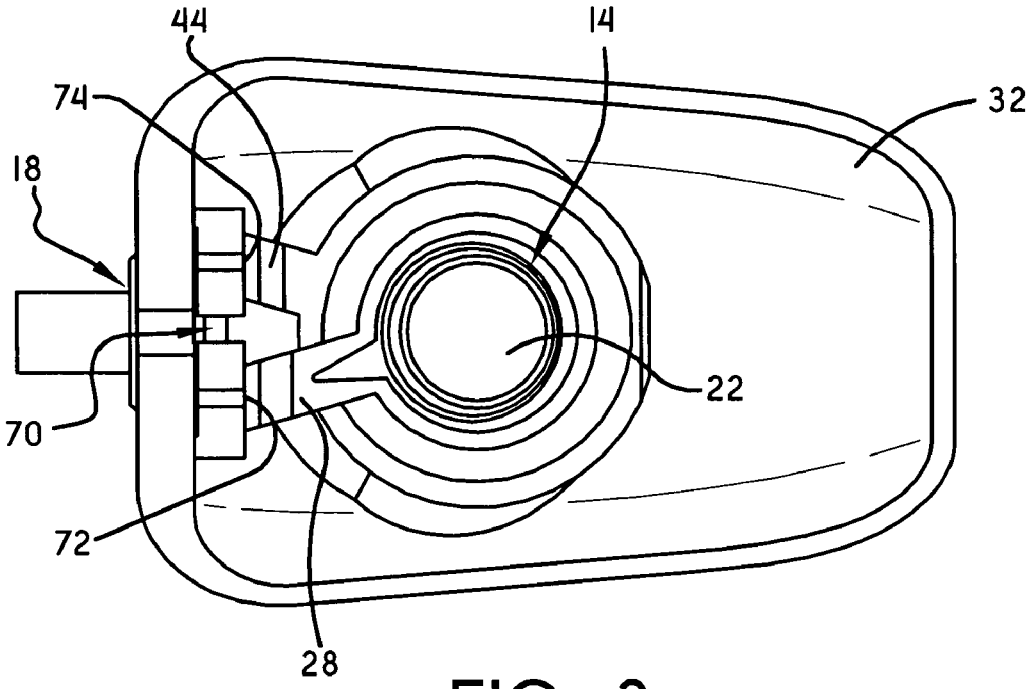
FIG. 3 is a top view as in FIG. 2, shown with a top film removed to show a liquid outlet path.
Figure 4:
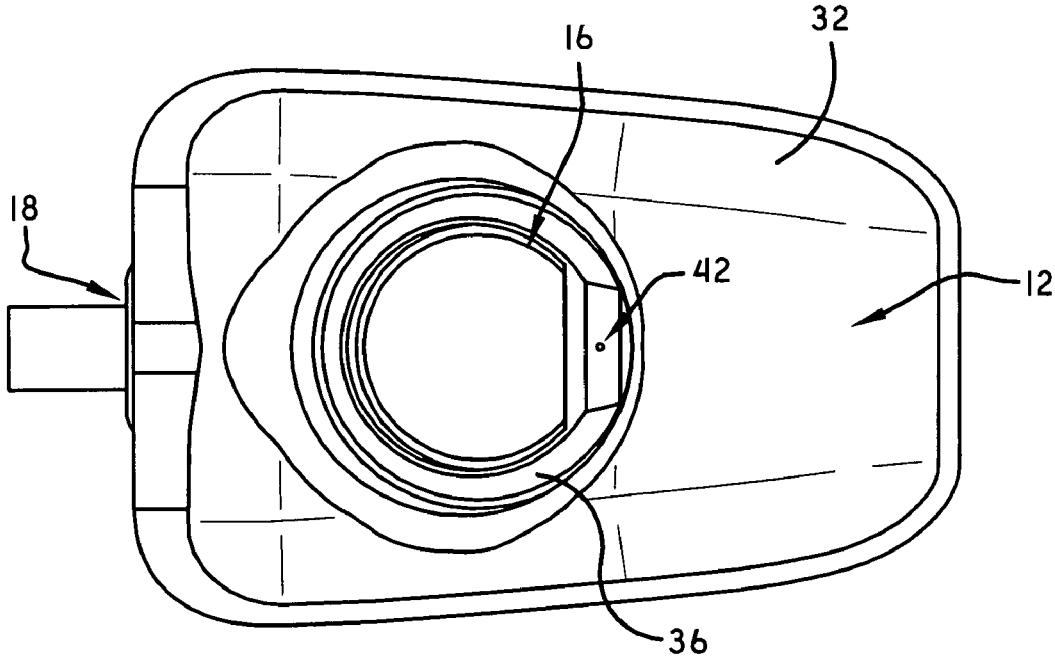
FIG. 4 is a bottom view of this first embodiments.
Figure 5:
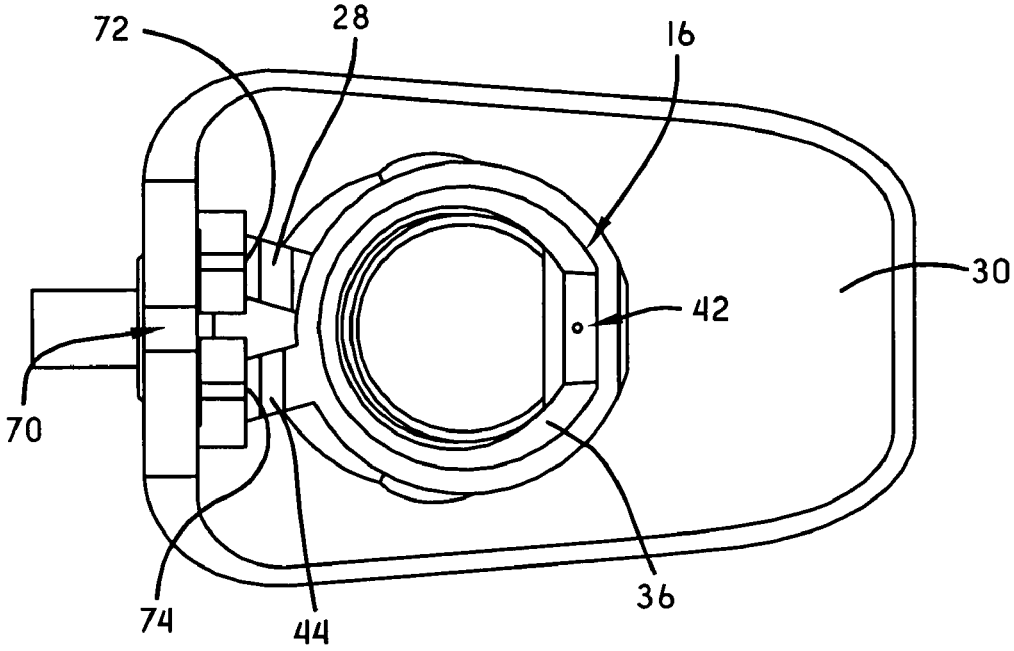
FIG. 5 is a bottom view as in FIG. 4, shown with a bottom film removed to show an air outlet path.

With reference to FIGS. 1-7, it can be seen that the dispenser of this invention is shown and designated by the numeral 10. The dispenser 10 includes a liquid container 12 that holds a liquid S. The dispenser further includes a liquid pump 14 and an air pump 16 (FIGS. 4 and 5). The liquid pump 14 is actuated to advance doses of liquid S to a mixing unit 18, while the air pump 16 is actuated to advance doses of air to the mixing unit 18. The dispenser 10 creates a desired product by mixing the air and liquid at the mixing unit 18.

Figure 7:
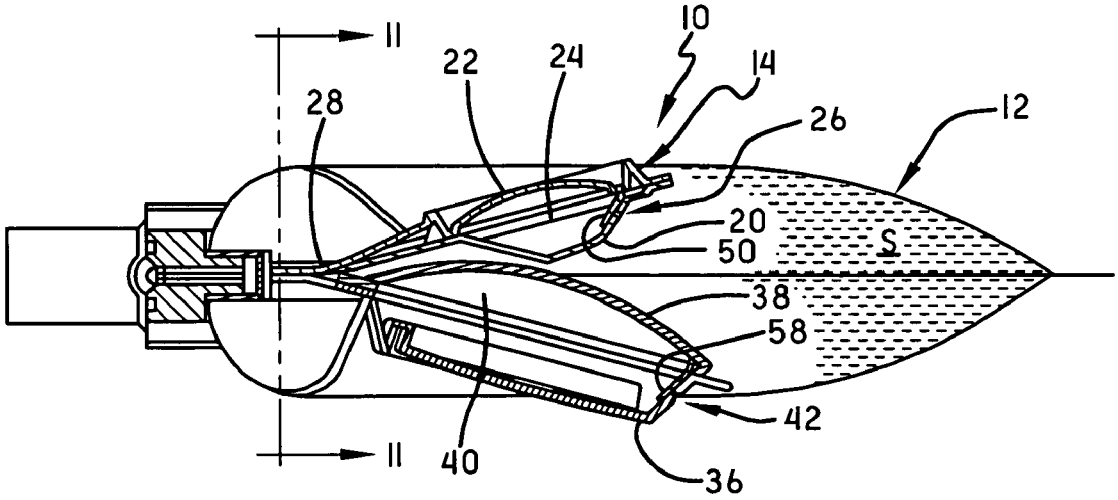
FIG. 7 is a cross section taken along the line 7-7 of FIG. 2, showing the dispenser in an unactuated state.
Figure 8:
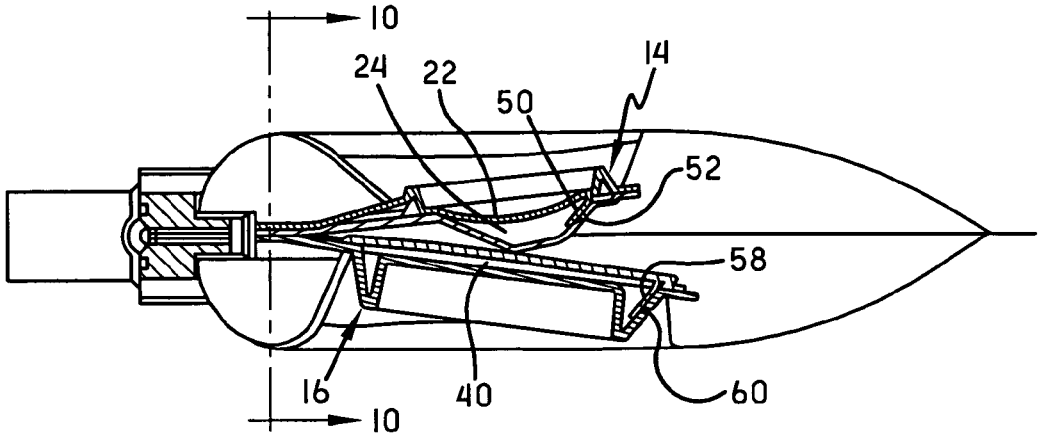
FIG. 8 is a cross section as in FIG. 7, but shows the dispenser in an actuated state.
Figure 9:
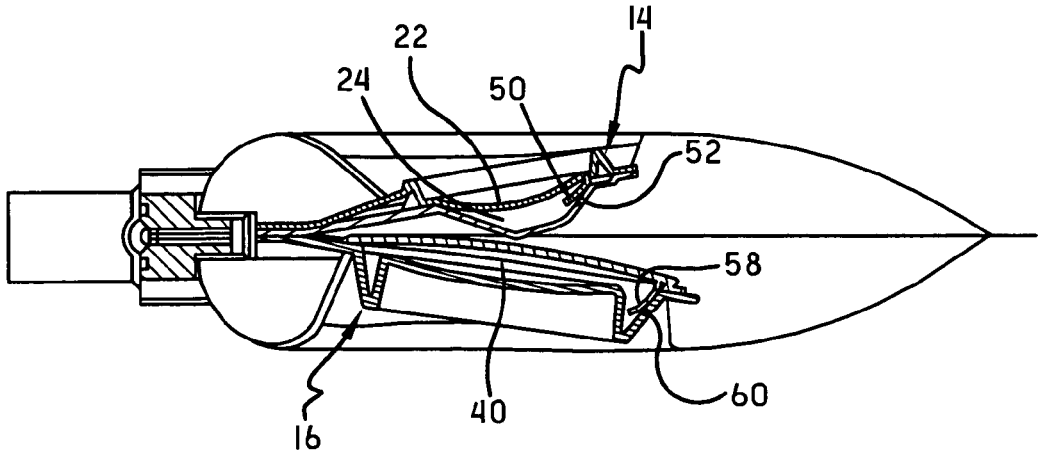
FIG. 9 is a cross section as in FIG. 7, but showing the dispenser at a time after release of the liquid pump and air pump from the actuated state.

The liquid pump 14 is formed of a base 20 and liquid dome 22 secured to the base 20 to define a collapsible liquid chamber 24. The collapsible liquid chamber 24 fluidly communicates with the liquid S in the liquid container 12 through a liquid inlet valve 26 (FIGS. 7-9). The collapsible liquid chamber 24 also fluidly communicates with a liquid outlet path 28 (FIG. 3) leading to the mixing unit 18. The liquid inlet valve 26 regulates the flow of fluid into the collapsible liquid chamber 24, and the special structure of the liquid outlet path 28 serves to regulate the flow of fluid out of the collapsible liquid chamber 24 and into the mixing unit 18, i.e., due to the structure of the liquid outlet path, it serves as a valve. This structure will be disclosed more fully herein below.

The liquid dome 22 is resilient, and may therefore be pushed in the direction of base 20, to collapse the collapsible liquid chamber 24 from an expanded volume (FIG. 7) to a compressed volume (FIG. 8). From the collapsed position, the liquid dome 22 is resilient enough to spring back to the rest position shown in FIG. 7, when pressure on the liquid dome 22 is released. As the liquid dome 22 is pushed towards base 20 to move the collapsible liquid chamber 24 to a compressed volume, pressure increases in the collapsible liquid chamber 24, and the contents thereof exit the collapsible liquid chamber 24 and enter the liquid outlet path 28. When pressure is released from the liquid dome 22, it springs back to its normal rest position, returning the collapsible liquid chamber 24 to its expanded volume. During the expansion, a vacuum is created in the collapsible liquid chamber 24, and liquid S is drawn through the liquid inlet valve 26 to recharge the collapsible liquid chamber 24 with a new dose of liquid S.

Figure 6:
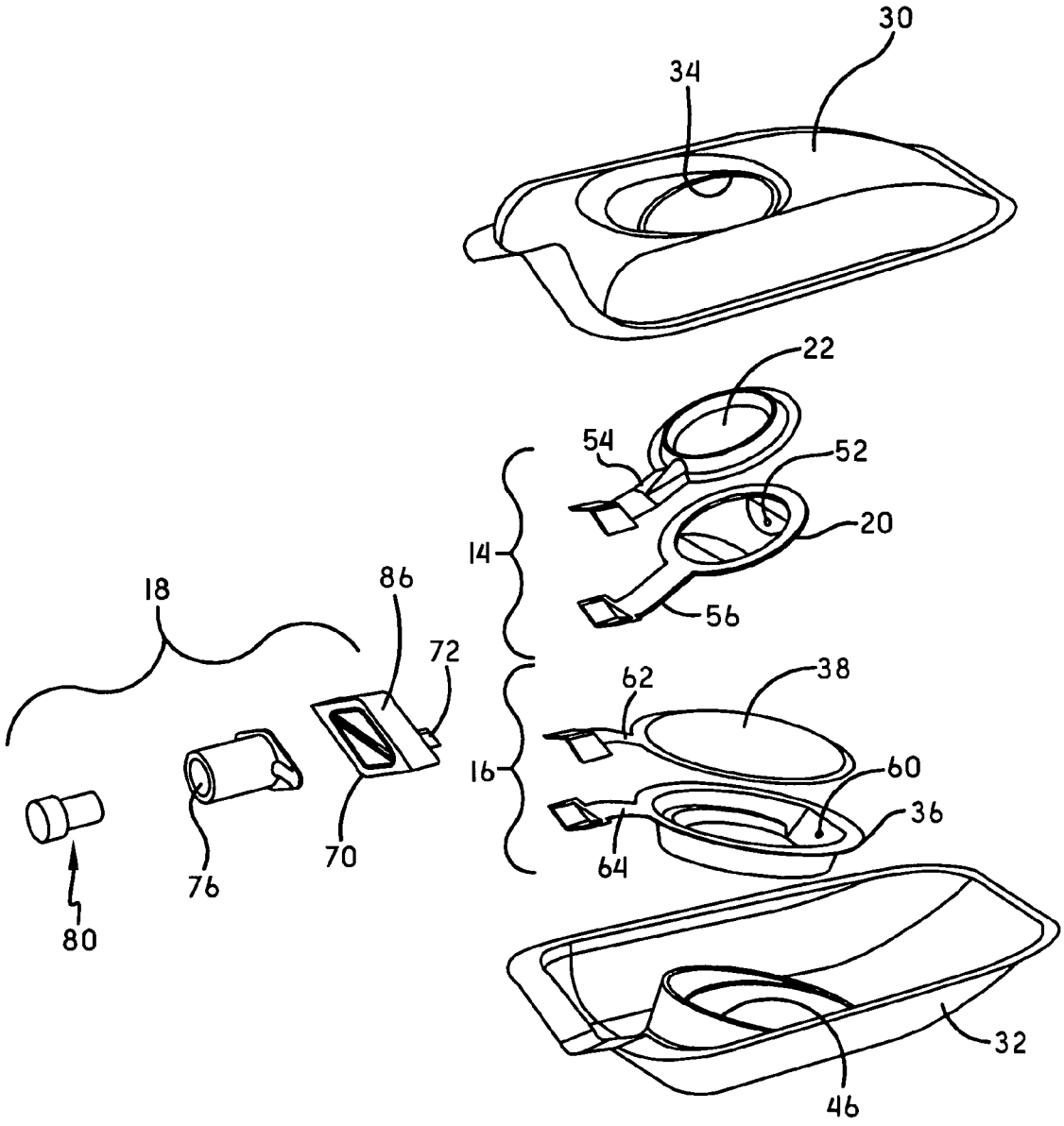
FIG. 6 is an assembly view, showing how independent elements are joined together to form the dispenser.

In this embodiment, as seen in FIG. 6, the liquid container 12 is formed from the top film 30 welded to a bottom film 32 at the perimeter. The liquid pump 14 is secured to the liquid container 12 at a top film 30. More particularly, the liquid dome 22 of the liquid pump 14 extends through a pump aperture 34 in the top film 30, and the liquid pump 14 is secured at this aperture 34 through welding or an appropriate adhesive. Alternatively, the pump aperture 34 could be omitted from the top film 30, and the liquid pump 14 could be retained completely inside of the liquid container 12 to be manipulated through the flexible top film 30. Because the top film 30 and bottom film 32 are sealed, flexible films, the liquid container 12 will collapse as doses of liquid S are drawn from the container 12, into the collapsible liquid chamber 24, upon compression and expansion of the collapsible liquid chamber 24.

With particular reference now to FIGS. 4-6, it can be seen that the air pump 16 is formed of a base 36 and an air dome 38 secured to the base 36 to define a collapsible air chamber 40. The collapsible air chamber 40 fluidly communicates with the atmosphere through an air inlet valve 42 (FIGS. 7-9) such that the atmosphere serves as a source of air. The collapsible air chamber 40 also fluidly communicates with an air outlet path 44 (FIG. 5) leading to the mixing unit 18. The air inlet valve 42 regulates the flow of air into the collapsible air chamber 40, and the special structure of the air outlet path 44 serves to regulate the flow of air out of the collapsible air chamber 40 and into the mixing unit 18. This special structure will be disclosed more fully herein below.

The air dome 38 is resilient, and therefore, as the base 36 is pushed in the direction of the liquid pump 14, the air dome 38 contacts the base 20 and is compressed toward the base 36 to collapse the collapsible liquid chamber 40 from an expanded volume (FIG. 7) to a compressed volume (FIG. 8). From the collapsed position, the air dome 38 is resilient enough to spring back to the rest position shown in FIG. 7, when pressure on the base 36 is released. As the air dome 38 is pushed towards base 36 to move the collapsible air chamber 40 to a compressed volume, pressure increases in the collapsible air chamber 40, and the contents of thereof exit the collapsible air chamber 40 and enter the air outlet path 44. When pressure is released from the air dome 38, it springs back to its normal rest position, returning the collapsible air chamber 40 to its expanded volume. During the expansion, a vacuum is created in the collapsible air chamber 40, and air is drawn through the air inlet valve 42 to recharge the collapsible air chamber 40 with a new dose of air.

In this embodiment, as seen in FIG. 6, the air pump 16 is secured to the liquid container 12 at the bottom film 32. More particularly, the base 36 of the air pump 16 extends through a pump aperture 46 in the bottom film 32, and the air pump 16 is secured at this aperture 46 through welding or an appropriate adhesive. Alternatively, the air pump 16 could be retained completely inside of the liquid container 12 and could be manipulated through the flexible bottom film 32 as described with respect to the liquid pump 14.

As seen in the figures, the liquid pump 14 and air pump 16 are preferably aligned with each other, with the base 20 of liquid pump 14 preferably abutting the air dome 38 of air pump 16. With such a structure, it is possible to simultaneously squeeze the domes 22 and 38 toward each other by holding the dispenser 10 with fingers pressing against one pump 14 or 16, and the thumb pressing against the other of pumps 14 or 16. In the configuration shown, the liquid dome 22 of the liquid pump 14 can be accessed and manipulated, while the base 36 of the air pump 16 can be accessed and manipulated, such that squeezing the two toward each other causes both the collapsible liquid chamber 24 and the collapsible air chamber 40 to collapse. The liquid container 12 is preferably sized suitably for such on-handed manipulation. The base 20 abuts the air dome 38 so that squeezing the liquid pump 14 and air pump 16 in this manner causes a substantially simultaneous collapse of the collapsible liquid chamber 24 and the collapsible air chamber 40. The collapsing of the chambers 24 and 40 causes the liquid S and air to be forced through their respective liquid outlet path 28 and air outlet path 44 and into the mixing unit 18, where structures are provided to cause the doses of air and liquid to further mix. In instances where the liquid is a foamable liquid (such as soap or foamable hand sanitizer), the mixing structures create a uniform foam dispensed at outlet 48.

More particulars of the structure of this embodiment will be appreciated during the following disclosure of the functioning of the dispenser 10. In FIG. 7, the dispenser 10 is shown in cross section, and is in a rest position, i.e., it is not actuated. In this unactuated state, the collapsible liquid chamber 24 contains a dose of liquid S, and the collapsible air chamber 40 contains a dose of air. Each of these collapsible chambers is collapsed to advance the dose of liquid and the dose of air to the mixing unit 18. This is shown in FIG. 8, wherein both the liquid pump 14 and the air pump 16 have been actuated. More particularly, the volumes of the collapsible liquid chamber 24 and the collapsible air chamber 40 have been reduced by squeezing the domes 22 and 38.

Figure 10:
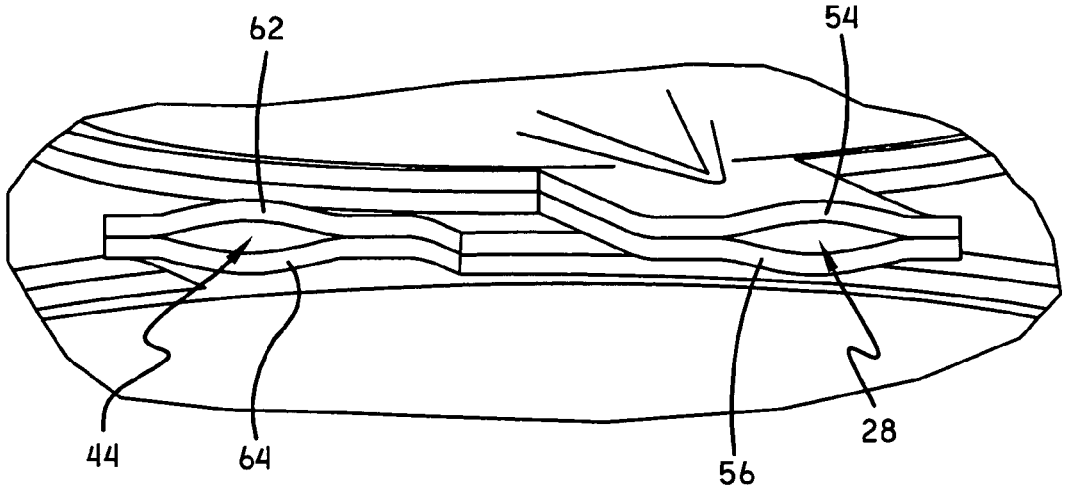
FIG. 10 is a cross section along the line 10-10 of FIG. 8, showing open outlet paths for the liquid and air.
Figure 11:
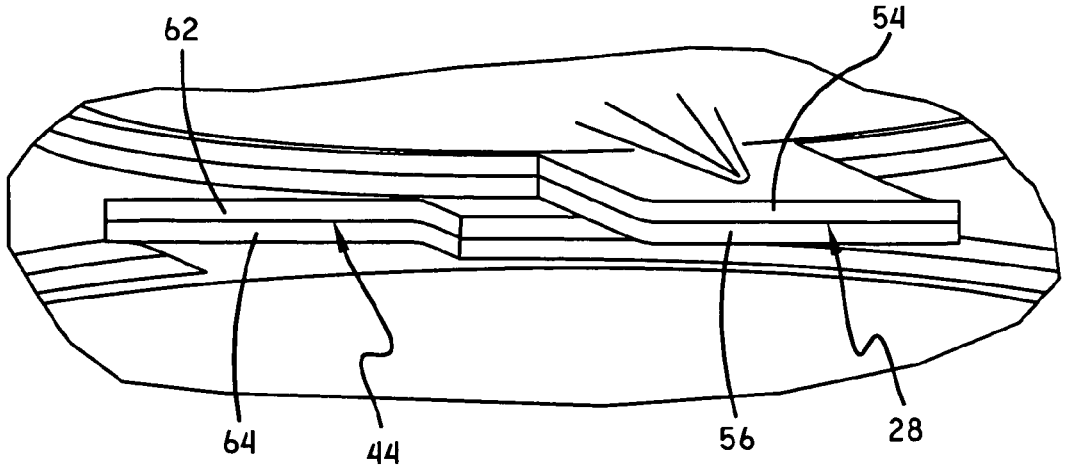
FIG. 11 is a cross section along the line 11-11 of FIG. 7, showing closed outlet paths for the liquid and air.
Figure 12:
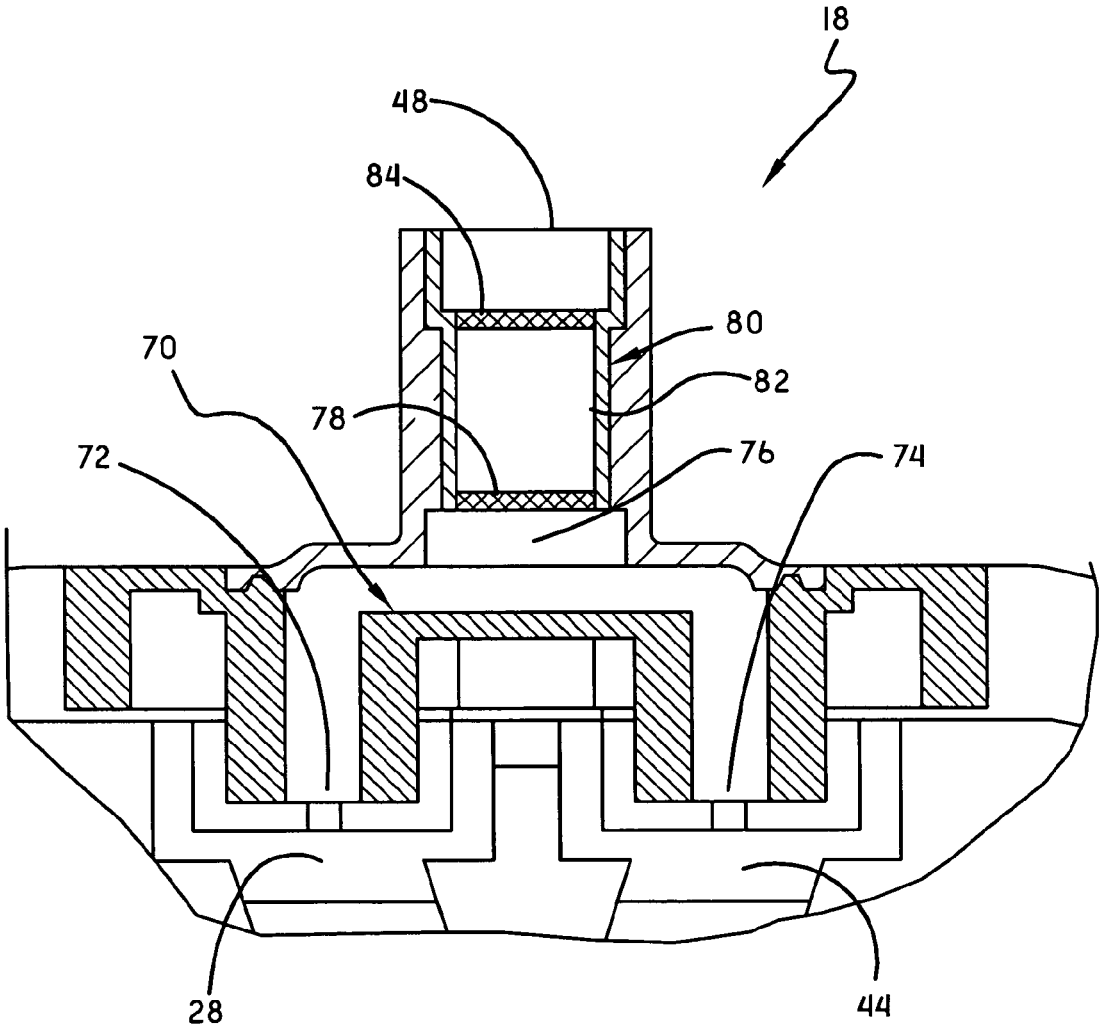
FIG. 12 is a cross section of the mixing unit.
Figure 13:
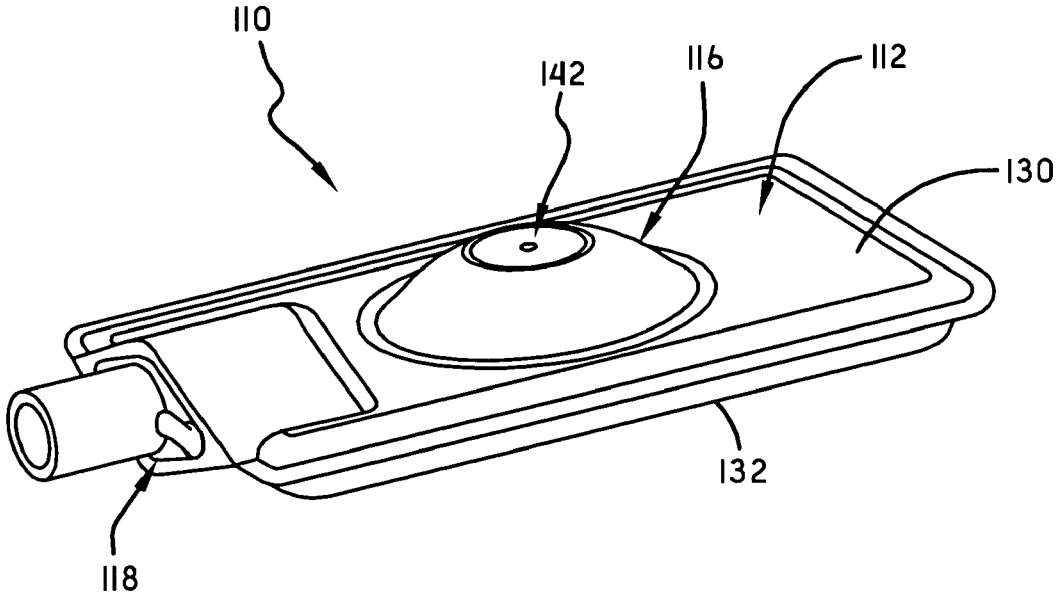
FIG. 13 is a perspective view of a second embodiment of a dispenser in accordance with this invention.
Figure 14:
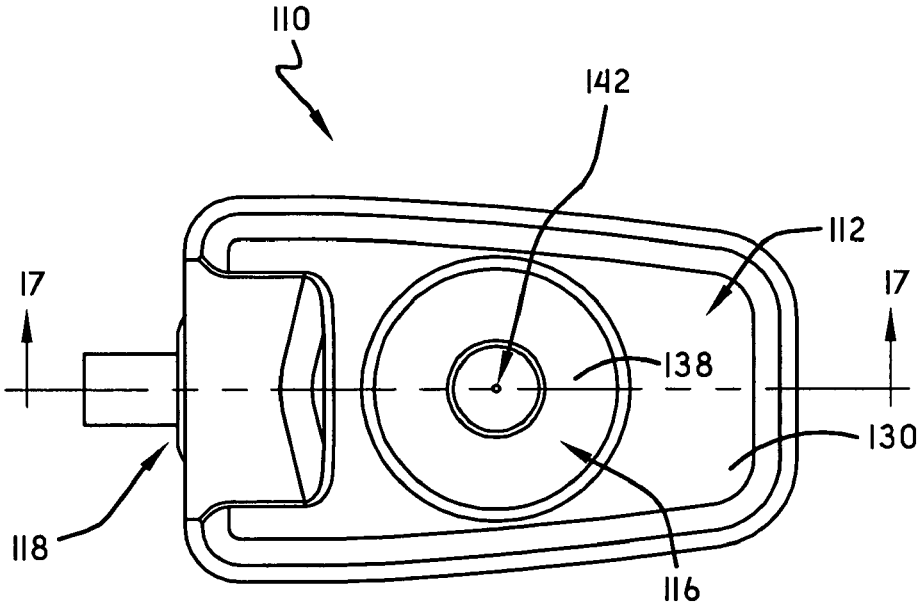
FIG. 14 is a top view of the second embodiment.

In the liquid pump 14, the collapsing of the collapsible liquid chamber 24 causes the liquid S held therein to be forced into and through the liquid outlet path 28, which is the only outlet from the collapsible liquid chamber 24, due to the closing of the liquid inlet valve 26. As seen in FIGS. 7 and 8, a flapper 50 extends from the flexible dome 22 to cover an inlet aperture 52 in base 20. Both at rest and during actuation, this flapper 50 extends over the inlet aperture 52, preventing the contents of the collapsible liquid chamber 24 from re-entering the liquid container 12. As the volume of the collapsible liquid chamber 24 is reduced, the liquid S therein must advance to the liquid outlet path 28. As seen in FIGS. 6, 10 and 11, the liquid outlet path 28 is formed of a top film 54 and a bottom film 56, which are sealed together at their perimeter such that, at rest, they are sandwiched together to resist the flow of liquid there through, i.e., the liquid outlet path 28 is closed. However, upon collapse of the collapsible liquid chamber 24, the pressure of the liquid being forced out of the collapsible liquid chamber 24 is sufficient to open this liquid outlet path 28 and permit the liquid S to travel to the mixing unit 18.

Similarly, in the air pump 16, the collapsing of the collapsible air chamber 40 causes the air held therein to be forced into and through the air outlet path 44, which is the only outlet from the collapsible air chamber 40, due to the closing of the air inlet valve 42. As seen in FIGS. 7 and 8, a flapper 58 extends from the flexible dome 38 to cover an inlet aperture 60 in the base 36. Both at rest and during actuation, this flapper valve 58 extends over the inlet aperture 60, preventing the contents of the collapsible air chamber 40 from exiting to the atmosphere. When the volume of the collapsible air chamber 40 is reduced, the air therein must advance to the air outlet path 44. As seen in FIGS. 6, 10 and 11, the air outlet path 44 is formed of a top film 62 and a bottom film 64, which are sealed together at their perimeter so as to be normally sandwiched together to resist the flow of air there through. However, upon collapse of the collapsible air chamber 40, the pressure of the air being forced out of the collapsible air chamber 40 is sufficient to open this air outlet path and permit the air to travel to the mixing unit 18.

With reference now to FIG. 9 the recharging of the collapsible liquid chamber 24 and the collapsible air chamber 40 with doses of liquid and air is described. Once the collapsing force on the liquid dome 22 is removed, the liquid dome 22 naturally reverts back to its non-collapsed position, as is shown in FIG. 9. This movement of the liquid dome 22 creates a vacuum in the collapsible liquid chamber 24, which causes the flapper 50 to be pulled off of the inlet aperture 52 in the base 20, drawing another dose of liquid S into the liquid pump 14. It will be appreciated that the liquid outlet path 28 also flattens back out, as in FIG. 11. Similarly, once the collapsible force on the air dome 38 is removed, the air dome 38 naturally reverts back to its non-collapsed position, as shown in FIG. 9. This movement of the air dome 38 creates a vacuum in the collapsible air chamber 40, which causes the flapper 58 to be pulled off the inlet aperture 60 in the base 36, drawing another dose of air into the air pump 16. The air outlet path 44 also flattens back out, as in FIG. 11.

With reference to FIGS. 3, 5, 6 and 12 it can be seen that the liquid outlet path 28 feeds into a manifold 70 at a liquid inlet 72, while the air outlet path 44 feeds into the manifold 70 at an air inlet 74. The separate air and liquid paths are brought together in the manifold 70 and forced through a common outlet path 76 toward outlet 48. At least one mesh screen 78 is provided in the outlet path 76 so that the coarse mixture of air and liquid formed at the joinder of the separate air and liquid paths can be homogenized into a more uniform mixture. In instances where the liquid is a foamable liquid, the homogenization serves to create a quality foam product to be dispensed at outlet 48. In accordance with particular embodiments, at least one mesh screen 78 is provided as a first screen in a mixing cartridge 80, which is a tube 82, bounded by the mesh screen 78 and a second mesh screen 84.

The mixing unit 18 provides a rigid canoe fitment 86, which is welded to the top film 30 and bottom film 32 of the liquid container. As best seen in FIG. 6, the top and bottom films 54, and 56 of the liquid outlet path 28 and the top and bottom films 62, 64 of the air outlet path 44 are heat sealed to the liquid inlet 72 and air inlet 74 of the manifold 70.

In this embodiment, a dispenser 10 is provided having a liquid pump opposite an air pump, such that the liquid pump and air pump can be squeezed towards each other to actuate those pumps and mix air and liquid to dispense a desired product. In particular embodiments, the liquid will be chosen to be a foamable liquid such as soap or foamable sanitizer, and the product dispensed will be in the form of a foam. The liquid container is sealed and preferably formed from flexible films such that the container collapses as doses of liquid are drawn into the collapsible liquid chamber. By structuring the container to be collapsible, the liquid in the container is always present at the location of the inlet valve to the collapsible liquid chamber. This helps ensure that doses of liquid are consistently drawn into the collapsible liquid chamber during expansion thereof. A more rigid, vented container structure could be employed, but might, at times need to be particularly oriented to avoid letting air enter the collapsible liquid chamber. Though the opposed liquid and air pump structure of this embodiment provided is easy to use, it will be appreciated that the liquid and air pumps might be positioned differently. Indeed, they might be positioned anywhere so long as the air pump communicates with a source of air and the liquid pump communicates with a source of liquid, with both pumps communicating with common outlet to cause the mixing of their individual components. In another embodiment disclosed below, the liquid pump is surrounded by the air pump in a pump-within-a-pump structure that extends from one side of the liquid container.

Figure 15:
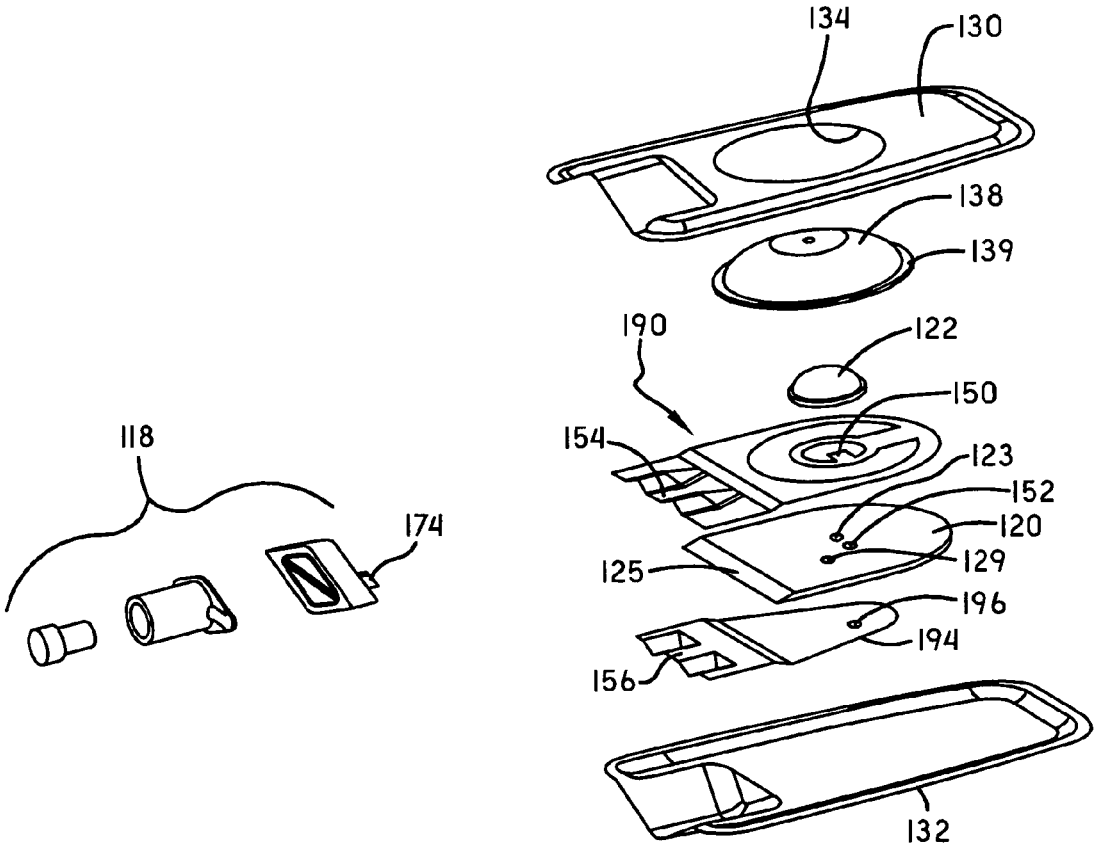
FIG. 15 is an assembly view showing how elements of the dispenser join together to form the dispenser, with the perspective being such that top portions of the elements are viewed.
Figure 16:
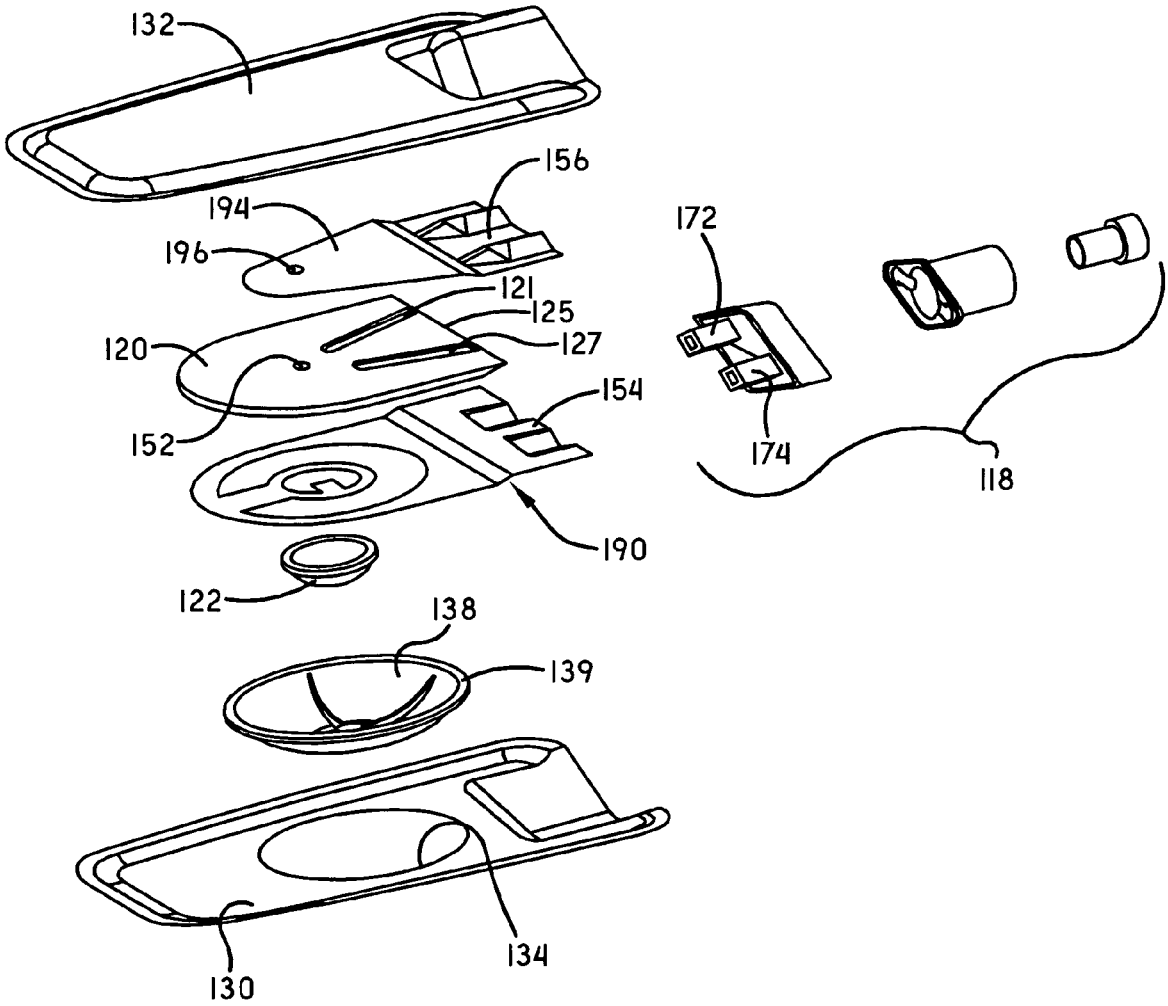
FIG. 16 is an assembly view as in FIG. 15, but with the perspective being such that bottom portions of the elements are viewed.
Figure 17:
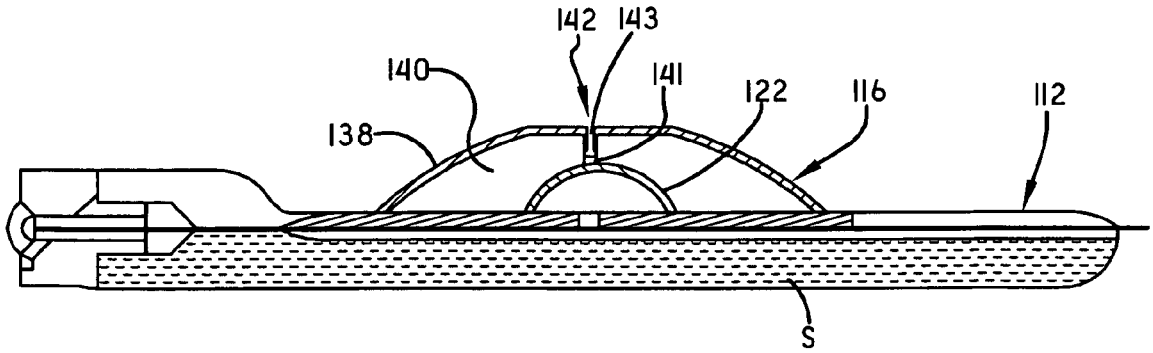
FIG. 17 is a cross section taken along the line 17-17 of FIG. 14.

Referring now to FIGS. 13-18, an embodiment of a dispenser showing a pump-within-a-pump structure is shown and designated by the numeral 110. The dispenser 110 includes a liquid container 112 that holds a liquid S. The dispenser 110 further includes a liquid pump 114 and an air pump 116 (FIG. 17). The liquid pump 114 is actuated to advance doses of liquid S to a mixing unit 118, while the air pump 116 is actuated to advance doses of air to the mixing unit 118. The dispenser 110 creates a desired product by mixing the air and liquid at the mixing unit 118.

The liquid pump 114 is formed by the interaction of a resilient liquid dome 122 with a more rigid channel plate 120 and a valve film 190. The liquid dome 122 is secured to the channel plate 120 to define a collapsible liquid chamber 124. The collapsible liquid chamber 124 fluidly communicates with the liquid S in the liquid container 112 through a liquid inlet valve 126 (FIG. 18), which regulates the flow of liquid S into the collapsible liquid chamber 124. The collapsible liquid chamber 124 also fluidly communicates with a liquid outlet path 128 (FIG. 18) leading to the mixing unit 118. The liquid outlet path 128 of this embodiment is structurally different than the liquid outlet path 28 of the previous embodiment, yet still functions to regulate the flow of fluid out of the collapsible liquid chamber 124 and into the mixing unit 118, as will be disclosed more fully herein below.

With particular reference now to FIGS. 15-17, it can be seen that the air pump 116 is formed of a resilient air dome 138 that surrounds the liquid dome 122 of the liquid pump 114. This air dome 138 is also secured to the channel plate 120, and thereby defines a collapsible air chamber 140. A spacer member 141 extends from the air dome 138 into the collapsible air chamber 140, and contacts or is in close proximity to the liquid dome 122. This spacer member 141 is beneficial because it causes the liquid dome 122 to begin collapsing upon pressing on the air dome 138. The collapsible air chamber 140 fluidly communicates with the atmosphere through an air inlet valve 142 (FIGS. 13 and 14) such that the atmosphere serves as a source of air. In this embodiment, the air inlet valve 142 is a passage 143 (FIG. 17) through the spacer member 141, and it serves to regulate air flow by being covered or uncovered by a finger or thumb of the operator of the dispenser 110. The collapsible air chamber 140 also fluidly communicates with an air outlet path 144 (FIG. 18) leading to the mixing unit 118. The air inlet valve 142 is provided to regulate the flow of air into the collapsible air chamber 140. The air outlet path 144 of this embodiment is structurally different than the air outlet path 44 of the previous embodiment, yet it still functions to regulate the flow of fluid out of the collapsible air chamber 140 and into the mixing unit 118, as will be disclosed more fully herein below.

Both the liquid dome 122 of liquid pump 114 and the air dome 138 of air pump 116 are resilient, and may therefore be pushed in the direction of channel plate 120, to collapse their respective collapsible liquid chamber 124 and collapsible air chamber 140 from expanded volumes (FIG. 17) to compressed volumes. From the collapsed position, both domes 122 and 138 are resilient enough to spring back to the rest position shown in FIG. 17, when pressure on the air dome 138 is released. As noted above, the pressure on the air dome 138 is translated to the liquid dome 122 by the spacer member 141. As the air dome 138 is pushed towards base 120 to move both the collapsible liquid chamber 124 and the collapsible air chamber 140 to compressed volumes, pressure increases in the two chambers 124 and 140, and the contents thereof enter their respective liquid outlet and air outlet paths 128 and 144. When pressure is released from the air dome 138, both the liquid dome 122 and the air dome 138 spring back to their normal rest positions, returning the collapsible liquid chamber 124 and the collapsible air chamber 140 to their expanded volumes. During the expansion, vacuums are created in the collapsible liquid chamber 128 and the collapsible air chamber 140, and liquid and air are drawn through the liquid inlet valve 126 and the air inlet valve 142 to recharge them with a new dose of liquid and air.

In this second embodiment, as seen in FIGS. 15 and 16, the air pump 116 is secured to the liquid container 112 at the top film 130. More particularly, the air dome 138 of the air pump 116 extends through a pump aperture 134 in the top film 30, and the air pump 116 is secured at this aperture 134 through welding or an appropriate adhesive at dome rim 139. Alternatively, the air pump 116 could be retained completely inside of the liquid container 112 and could be manipulated through the flexible top film 130.

As seen in FIG. 15, the air pump 116 surrounds the liquid pump 114 concentrically, though the liquid pump 114 could be off center. The liquid pump 114 and the air pump 116 are formed by welding or otherwise adhering the liquid dome 122 and air dome 138 to a valve film 190 that, together with the channel plate 120, provides the valve structure necessary for the liquid pump 114 to function. The functioning of the air pump 116 is facilitated by the functioning of the air inlet valve 142. With this structure, it is possible to collapse both the domes 122 and 138 by holding the dispenser 110 with fingers underneath the bottom film 132 and the thumb pressing against and covering the air inlet valve 142. The liquid container 112 is preferably sized suitably for such one-handed manipulation. The collapsing of the chambers 124 and 140 causes the liquid S and air to be forced through their respective liquid and air outlet paths 128 and 144 and into the mixing unit 118, which, in this embodiment, is substantially identical to the mixing unit 118 of the first embodiment.

More particulars of the structure of this second embodiment will be appreciated during the following disclosure of the functioning of the dispenser 110. In FIG. 17, the dispenser 110 is shown in cross section, and is in a rest position, i.e., it is not actuated. In this unactuated state, the collapsible liquid chamber 124 contains a dose of liquid S, and the collapsible air chamber 140 contains a dose of air. Each of these collapsible chambers can be collapsed to advance the dose of liquid and the dose of air to the mixing unit 118. The collapsible chambers are collapsed by finger pressure, moving the air dome 138 and thus the liquid dome 122 toward the channel plate 120.

Figure 18:
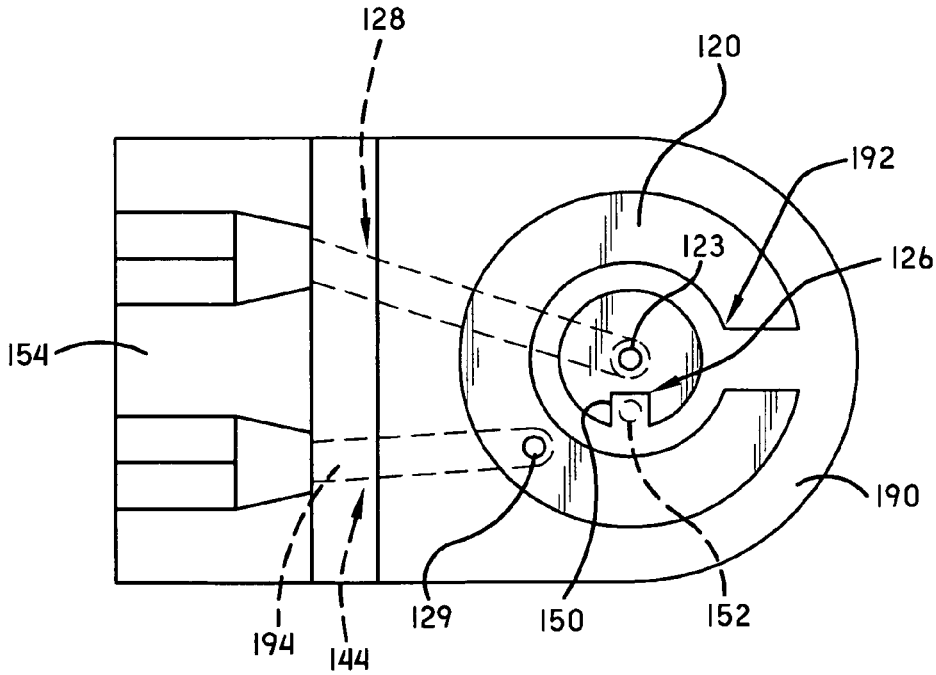
FIG. 18 is top plan view of an assembly of the valve film, the channel plate, and the channel film elements of the second embodiment, provided to aid in appreciating the formation of liquid and air channels and the functioning of the liquid inlet valve of the liquid pump.

In the liquid pump 114, the collapsing of the collapsible liquid chamber 124 causes the liquid S held therein to be forced into and through the liquid outlet path 128, which is the only outlet from the collapsible liquid chamber 124, due to the closing of the liquid inlet valve 126. As seen in FIG. 18, which is a top view of the assembly of the valve film 190, the channel plate 120 and a channel film 194 (FIGS. 15 and 16), a flapper 150 provided in a peninsular extension 192 of the valve film 190 covers a liquid inlet aperture 152 in channel plate 120. Both at rest and during actuation, this flapper 150 extends over the inlet aperture 152, preventing the contents of the collapsible liquid chamber 124 from re-entering the liquid container 112. As the volume of the collapsible liquid chamber 124 is reduced, the liquid S therein must advance to the liquid outlet path 128. The liquid outlet path 128 is formed by a liquid channel 121 (FIG. 16) in channel plate 120 covered by the channel film 194. The liquid channel 121 extends from a liquid outlet aperture 123 in channel plate 120 to the front edge 125 thereof, where a top film 154, provided by an extension of the valve film 190, and a bottom film 156, provided by an extension of the channel film 194, are sealed together around a liquid inlet port 172 of the mixing unit 118.

Similarly, in the air pump 116, the collapsing of the collapsible air chamber 140 causes the air held therein to be forced into and through the air outlet path 144, which is the only outlet from the collapsible air chamber 140, due to the closing of the air inlet valve 142 by a user's finger or thumb, during actuation. As seen in FIGS. 15, 16 and 18, the volume of the collapsible air chamber 140 communicates with an air channel 127 in channel plate 120 through an air outlet aperture 129. When the air inlet valve 142 is covered and the volume of the collapsible air chamber 140 is reduced, the air therein must advance to the air outlet path 144. The air outlet path 144 is formed by the air channel 127 covered by the channel film 194, and this outlet path 144 extends to the front edge 125 of the channel plate 120 where the top film 154 provided by an extension of the valve film 190 and the bottom film 156 provided by an extension of the channel film 194, are sealed together around an air inlet port 174 of the mixing unit 118.

Once the collapsing force on the air dome 138 is removed, both the air dome 138 and the liquid dome 122 revert back to their non-collapsed position, as is shown in FIG. 17. This movement of the liquid dome 122 creates a vacuum in the collapsible liquid chamber 124, which causes the flapper 150 to be pulled off of the liquid inlet aperture 152 in the channel plate 120, drawing another dose of liquid S into the liquid pump 114. The channel film 194 includes an aperture 196 aligned with the liquid inlet aperture 152 so that the channel film 194 does not interfere with the charging of another dose of liquid. Movement of the air dome 138 also creates a vacuum in the collapsible air chamber 140, causing air to be pulled in through the passage 143 to fill the collapsible air chamber with air.

As with the first embodiment disclosed above, the separate air and liquid paths are brought together in a mixing unit 118, which is substantially identical to the mixing unit 18.

In this embodiment, a dispenser 110 is provided having an air pump surrounding a liquid pump, such that pressing on the air pump can actuate both those pumps and mix air and liquid to dispense a desired product. In particular embodiments, the liquid will be chosen to be a foamable liquid such as soap or foamable sanitizer, and the product dispensed will be in the form of a foam. The liquid container is sealed and preferably formed from flexible films such that the container collapses as doses of liquid are drawn into the collapsible liquid chamber. By structuring the container to be collapsible, the liquid in the container is always present at the location of the inlet valve to the collapsible liquid chamber. This helps ensure that doses of liquid are consistently drawn into the collapsible liquid chamber during expansion thereof. A more rigid, vented container structure could be employed, but might, at times need to be particularly oriented to avoid having air enter the collapsible liquid chamber.

From the forgoing, it should be apparent that the present invention advances the art of dispensers by providing a handheld personal dispenser suitable for mixing a liquid with air to create a desired end product. While the invention is intended in some embodiments to provide a personal dispenser for foamed hand soaps or foamed hand sanitizers, the invention is not limited thereto or thereby, and may be employed to mix virtually any liquid with air for virtually any purpose. The following claims will serve to define the invention.

What is claimed is:

1. A handheld dispenser for dispensing air mixed with a liquid, the handheld dispenser comprising:

a collapsible liquid container holding a liquid;

a mixing chamber;

a liquid dome pump including a resilient liquid dome and a liquid pump base defining a collapsible liquid chamber communicating with said mixing chamber through a liquid outlet path, wherein said collapsible liquid chamber is manipulated between an expanded volume and a contracted volume by pressing on said resilient liquid dome toward said liquid pump base, said collapsible liquid chamber communicating with said liquid in said liquid chamber through a liquid valve; and an air dome pump including a resilient air dome and an air pump base defining a collapsible air chamber communicating with said mixing chamber through an air outlet path, wherein said collapsible air chamber is manipulated between an expanded volume and a contracted volume by pressing on said resilient air dome toward said air pump base, said collapsible air chamber communicating with air outside the dispenser through an air valve, said collapsible liquid chamber and said collapsible air chamber being secured to said collapsible liquid container so as to be capable of manipulation with one hand;

wherein a portion of said liquid in said collapsible liquid container is drawn into said collapsible liquid chamber upon expansion of said collapsible liquid chamber from said contracted volume to said expanded volume, and a portion of said liquid within said collapsible liquid chamber is expelled from within said collapsible liquid chamber and forced to said liquid outlet path upon contraction of said collapsible liquid chamber from said expanded volume to said contracted volume, wherein air is drawn into said collapsible air chamber upon expansion of said collapsible air chamber from said contracted volume to said expanded volume, and air within said collapsible air chamber is expelled from within said collapsible air chamber and forced to said air outlet path upon contraction of said collapsible air chamber from said expanded volume to said contracted volume, and wherein air forced through said air outlet path and liquid forced through said liquid outlet path create a mixture of air and liquid at said mixing chamber.

2. The handheld dispenser of claim 1, wherein said liquid dome pump is positioned opposite said air dome pump such that their respective resilient liquid dome and resilient air dome are simultaneously manipulated by squeezing said liquid dome pump toward said air dome pump.

3. The handheld dispenser of claim 2, wherein said collapsible liquid container is formed from a top film sealed to a bottom film, and said liquid dome pump is associated with said top film and said air dome pump is associated with said bottom film.

4. The handheld dispenser of claim 3, wherein said liquid pump base is secured to said top film.

5. The handheld dispenser of claim 4, wherein said air pump base is secured to said bottom film.

6. The handheld dispenser of claim 5, wherein said liquid outlet path is formed of top and bottom film members joined together.

7. The handheld dispenser of claim 6, wherein said air outlet path is formed of top and bottom film members joined together.

8. The handheld dispenser of claim 1, wherein said liquid is a foamable liquid such that said mixture of air and liquid at said mixing chamber create a foam product.

9. The handheld dispenser of claim 1, wherein said collapsible liquid chamber is at least partially surrounded by said collapsible air chamber.

10. A handheld dispenser for dispensing air mixed with a liquid, the handheld dispenser comprising:

a collapsible liquid container holding a liquid;

a mixing chamber;

a liquid pump including a collapsible liquid chamber communicating with said mixing chamber through a liquid outlet path, wherein said collapsible liquid chamber is adapted to be manipulated between an expanded volume and a contracted volume, said collapsible liquid chamber communicating with said liquid in said liquid chamber through a liquid valve; and an air pump including a collapsible air chamber communicating with said mixing chamber through an air outlet path, wherein said collapsible air chamber is adapted to be manipulated between an expanded volume and a contracted, said collapsible air chamber communicating with air outside the dispenser through an air valve, said collapsible liquid chamber and said collapsible air chamber being secured to said collapsible liquid container so as to be capable of manipulation with one hand;

wherein a portion of said liquid in said collapsible liquid container is drawn into said collapsible liquid chamber upon expansion of said collapsible liquid chamber from said contracted volume to said expanded volume, and a portion of said liquid within said collapsible liquid chamber is expelled from within said collapsible liquid chamber and forced to said liquid outlet path upon contraction of said collapsible liquid chamber from said expanded volume to said contracted volume, wherein air is drawn into said collapsible air chamber upon expansion of said collapsible air chamber from said contracted volume to said expanded volume, and air within said collapsible air chamber is expelled from within said collapsible air chamber and forced to said air outlet path upon contraction of said collapsible air chamber from said expanded volume to said contracted volume, wherein air forced through said air outlet path and liquid forced through said liquid outlet path create a mixture of air and liquid at said mixing chamber, and wherein said collapsible liquid chamber is formed in part by a resilient liquid dome, said collapsible air chamber is formed in part by a resilient air dome, and said resilient air dome surrounds said resilient liquid dome.

11. The handheld dispenser of claim 10, further comprising a channel plate including an liquid inlet aperture and a liquid outlet aperture, said resilient liquid dome surrounding said liquid inlet and liquid outlet apertures, said liquid inlet aperture providing communication between the interior of said collapsible liquid container and said collapsible liquid chamber and said liquid outlet aperture providing communication between said collapsible liquid chamber and said liquid outlet path.

12. The handheld dispenser of claim 11, further comprising a one-way valve at said liquid inlet aperture of said channel plate, said one-way valve permitting fluid flow into said collapsible liquid chamber through said liquid inlet aperture, and prohibiting fluid flow from inside said collapsible liquid chamber through said liquid inlet aperture.

13. The handheld dispenser of claim 11, wherein said channel plate includes an air outlet aperture and said resilient air dome surrounds said air outlet aperture, said air outlet aperture providing communication between said collapsible air chamber and said air outlet path.

14. The handheld dispenser of claim 13, wherein said resilient air dome includes an air inlet valve providing communication between said collapsible air chamber and the atmosphere.

15. The handheld dispenser of claim 14, wherein said air inlet valve is a passage extending through said resilient air dome and communicating between the atmosphere and said collapsible air chamber, such that said passage is covered by the user to close aid air inlet valve and is selectively uncovered to open said air inlet valve.

16. The handheld dispenser of claim 15, wherein said liquid is a foamable liquid such that said mixture of air and liquid at said mixing chamber create a foam product.

* * * * *